US005292234A

United States Patent [19]

Ling

[11] Patent Number: 5,292,234

[45] Date of Patent: Mar. 8, 1994

[54] SYSTEM FOR PREVENTING CAVITATION IN AN HYDRAULIC PUMP

[75] Inventor: Ching-Chung Ling, Plymouth, Mich.

[73] Assignee: Ford Motor Company, Dearborn, Mich.

[21] Appl. No.: 55,592

[22] Filed: May 3, 1993

[51] Int. Cl.[5] ..... F04B 49/02

[52] U.S. Cl. ..... 417/309

[58] Field of Search ..... 417/309, 310

[56] References Cited

U.S. PATENT DOCUMENTS

| | | | |
|---|---|---|---|
| 2,683,418 | 7/1954 | Smith | 417/309 |
| 3,182,596 | 5/1965 | Prijatel | 417/309 |
| 3,224,662 | 12/1965 | Oldberg | 417/309 |
| 4,222,712 | 9/1980 | Huber | 417/309 X |

*Primary Examiner*—Richard E. Gluck

*Attorney, Agent, or Firm*—Frank G. McKenzie; Roger L. May

[57] ABSTRACT

In a positive displacement hydraulic pump (68), a system for preventing cavitation includes a regulator valve, a valve spool (74) formed with control lands (76,78) moveable within a bore (72) communicating with control pressure taken at an inlet port (100) and control pressure at a reservoir inlet port (62). The spool opens and closes a connection between the inlet port (96) and outlet port (90) in accordance with changes in differential pressure between the reservoir (atmospheric pressure) and pressure in the inlet port (100). When the differential pressure is low, the valve closes the connection; when the differential pressure is large, the valve opens the connection.

4 Claims, 2 Drawing Sheets

SYSTEM FOR PREVENTING CAVITATION IN AN HYDRAULIC PUMP

BACKGROUND OF THE INVENTION

1. FIELD OF THE INVENTION

This invention pertains to the field of hydraulic pump controls and more particularly to controls for preventing excessively low pressure and resulting cavitation in the pump.

2. DESCRIPTION OF THE PRIOR ART

An hydraulic pump includes an inlet port, which is supplied with fluid from a reservoir or other source of hydraulic fluid, an outlet port connected to a pressure line, pumping chambers to carry the fluid from the inlet port to the outlet port, and a mechanical drive for activating the pumping chambers. In most hydraulic pumps the pumping chambers increase in size as they rotate toward the inlet, thereby creating a partial vacuum in the chambers. The chambers then decrease in size as they rotate toward and approach the outlet in order to push fluid from the chamber into the system. The vacuum at the inlet is used to create a pressure difference so that fluid will flow from the reservoir into the pumping chambers. However, in many systems the inlet is charged or supercharged, a technique in which a positive pressure, rather than a vacuum, is produced at a pressurized reservoir to create a head of fluid above the inlet. Frequently a low pressure charging pump is used to force fluid into the pumping chambers.

There are many different types of pumps used to pressurize hydraulic systems. Such pumps are generally fixed, constant displacement or variable, adjustable displacement versions. In a fixed displacement pump, the flow rate can be changed only by varying the drive speed. In a variable displacement pump, there is provision for changing the size of the pumping chambers so that the flow rate can be changed by moving the displacement control or changing the drive speed or both of these.

Cavitation is a condition that often occurs in a pump inlet when fluid is supplied at an insufficient rate to supply enough oil to keep the inlet filled. The condition produces in the hydraulic fluid bubbles, which implode as they are exposed to system pressure at the outlet of the pump. In addition to excessive pump speed, other reasons for cavitation include excessive restriction in the inlet line, too low a location of the reservoir level below the inlet, and high viscosity of hydraulic fluid. Ideally there should be no vacuum or even a slight positive pressure at the pump inlet; otherwise, cavitation can result.

Cavitation causes erosion of metal within the pump and increases deterioration of the hydraulic fluid. A badly cavitating pump makes a very distinctive noise as the bubbles implode under pressure.

A positive method to make sure that a pump does not cavitate is to check the inlet with a vacuum guage. Cavitation is prevented by keeping the inlet clean and free of obstructions, by using as large and as short an inlet line as possible with minimum number of bends, and by operating within rated drive speeds.

One way to avoid cavitation in a pump is to pressurize the pump inlet. The easiest way to charge the inlet is by locating the reservoir above the pump inlet. Where this is not possible and acceptable conditions cannot be created otherwise, a pressurized reservoir is often used. An auxiliary pump can be used also to maintain a supply of fluid to the inlet at low pressure. Generally a charging pump is used for this purpose, or a positive displacement pump is used with pressure relief valves set to maintain a desired charging pressure.

SUMMARY OF THE INVENTION

In an automatic transmission the hydraulic pump is generally a gear pump or a generated-rotor pump, in which gear teeth carry fluid from the inlet port to the outlet port. The velocity of fluid at the tip of the gear is generally equal to the speed of the gear. In an automatic transmission, when pump speed approaches 4000 rpm, pump flow starts to cavitate and becomes progressively more severe as pump speed increases. Cavitation becomes especially acute when hydraulic pressure in the pump inlet port is near or below the vapor pressure of the hydraulic fluid. As the pumping elements rotate they carry fluid in the pumping chambers substantially at the same velocity as the pump rotor. Accordingly, velocity pressure is large and static pressure at the inlet port as the pumping elements sweep through the arcuate opening of the inlet port is low.

It is an object of this invention to avoid cavitation in a fixed or variable displacement pump of an automatic transmission without requiring use of an additional charging pump to supply positive pressure to the reservoir or to the pump inlet. The system according to this invention includes a regulator valve having a spool moveable within a valve bore, the bore communicating with valve ports that are connected to the pump outlet and pump inlet. The valve spool moves within the bore in accordance with the magnitude of a pressure differential applied across a control land. The pressure differential is taken between the pressure at the pump outlet and inlet. Ordinarily, i.e., when this pressure differential is low, the valve closes a connection between the outlet port and inlet port. However, when the pressure differential across the valve control land rises to a predetermined magnitude, the valve opens a connection between the outlet and inlet, thereby increasing pressure at the pump inlet and preventing cavitation.

DESCRIPTION OF THE PREFERRED EMBODIMENT

Figure 1:
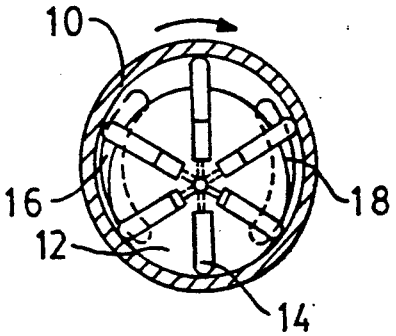
FIG. 1 is a cross section through an hydraulic vane pump.

Pumps that supply fluid to hydraulic systems can take various forms including those shown in FIGS. 1–4. The vane pump of FIG. 1 includes a pump casing 10 surrounding a rotor 12 driven by a prime mover, such as an internal combustion engine. The rotor includes radially directed slots that hold rectangular sliding vanes 14, the assembly of vanes and rotor being located eccentrically from the center of the housing. As the rotor turns, the vanes are forced against the inner surface of the cam ring by centrifugal force. Hydraulic fluid from a reservoir enters the pumping chambers, the space between the vanes 14, the outer surface of the rotor 10, and the inner surface of control ring 10, through an inlet port 16. As the volume of the pumping chambers increases, hydraulic fluid is forced from the pumping chambers through an outlet port 18. When a pump of this type is operating correctly, virtually the entire space of each pumping chamber is filled with hydraulic fluid on the inlet side of the pump, i.e., the zone in which the pumping chambers increases in size. As the rotor turns clockwise as shown in FIG. 1, hydraulic fluid is forced from the pumping chambers on the outlet side of the pump as the volume of the pumping chambers decreases.

The gear pump includes a casing 20 in which two spur gears 22,24 are supported rotatably with their teeth mutually intermeshing. Hydraulic fluid is drawn into the casing through an inlet port 26 and leaves the casing through an outlet port 28. As the gears rotate, fluid trapped between the gear teeth and the housing, is carried along the casing walls from the inlet to the outlet. A mechanical seal between the inlet and the outlet is formed by the meshing of the gears and the fit between the gears and the pump casing.

Figure 2:
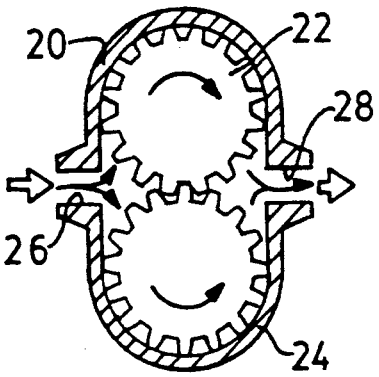
FIG. 2 is a cross section through a spur gear pump.
Figure 3:
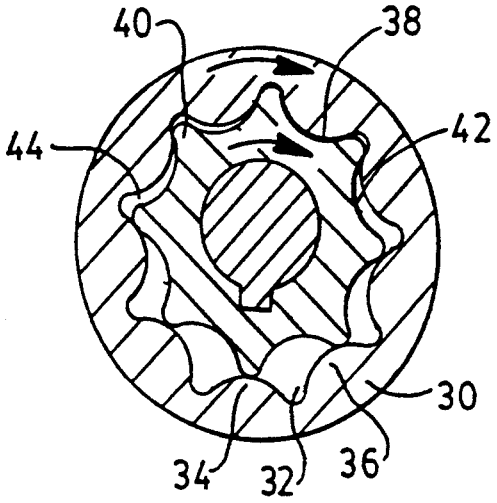
FIG. 3 is a cross section through a generated rotor pump.

FIG. 3 shows the form of a generated-rotor pump, which includes a casing 30 formed with multiple lobes 34,36 spaced angularly about the axis of the rotor, the lobes forming a series of depressions 32 between each of the lobes. A rotor 38, mounted rotatably about an axis eccentric from the axis of the casing, is driven by an engine or other power source. The rotor is formed with projections 42, one less projection than the number of recesses 32 located between each projection on the rotor. The projections 42 sized and shaped so that they are complimentary to the lobes 36 on the casing 30. As the rotor turns, fluid is admitted through an inlet port 42 into the space between the inner surface of the casing and the outer surface of the rotor. Fluid is carried forward to an outlet port 44 where fluid leaves the pumping chamber due to progressive reduction in volume of the space between the rotor and casing as the rotor turns clockwise, as shown in FIG. 3.

Figure 4:
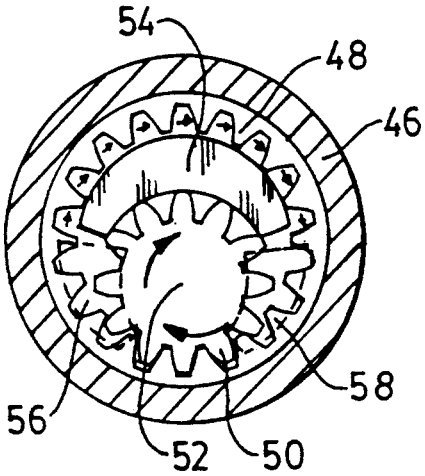
FIG. 4 is a cross section through an internal gear pump.

An internal gear pump of the type is shown in FIG. 4 includes an inner gear 52, a larger external gear 48 meshing over a portion of its arcuate length with gear 52, a crescent seal 54, and a closely fitting housing 46. The inner and outer gears are not concentric; therefore, as the rotor turns, it drives gear 48, and pumping chambers located between the inner gear and external gear expand in volume near the inlet 56 and decrease in volume near the outlet 58. Fluid is drawn into the pumping chambers through the inlet port 56 by constant movement of teeth on gear 52 past inlet 56. Fluid is carried counter clockwise from inlet 56 to outlet 58 in the spaces between the inner surfaces of casing 46, external gear 48 and seal 54 and in the spaces between the outer surfaces of inner gear 52 and the crescent seal 54. As the inner and outer gears rotate, fluid located in these spaces is forced from the spaces through the outlet port 58.

Figure 5:
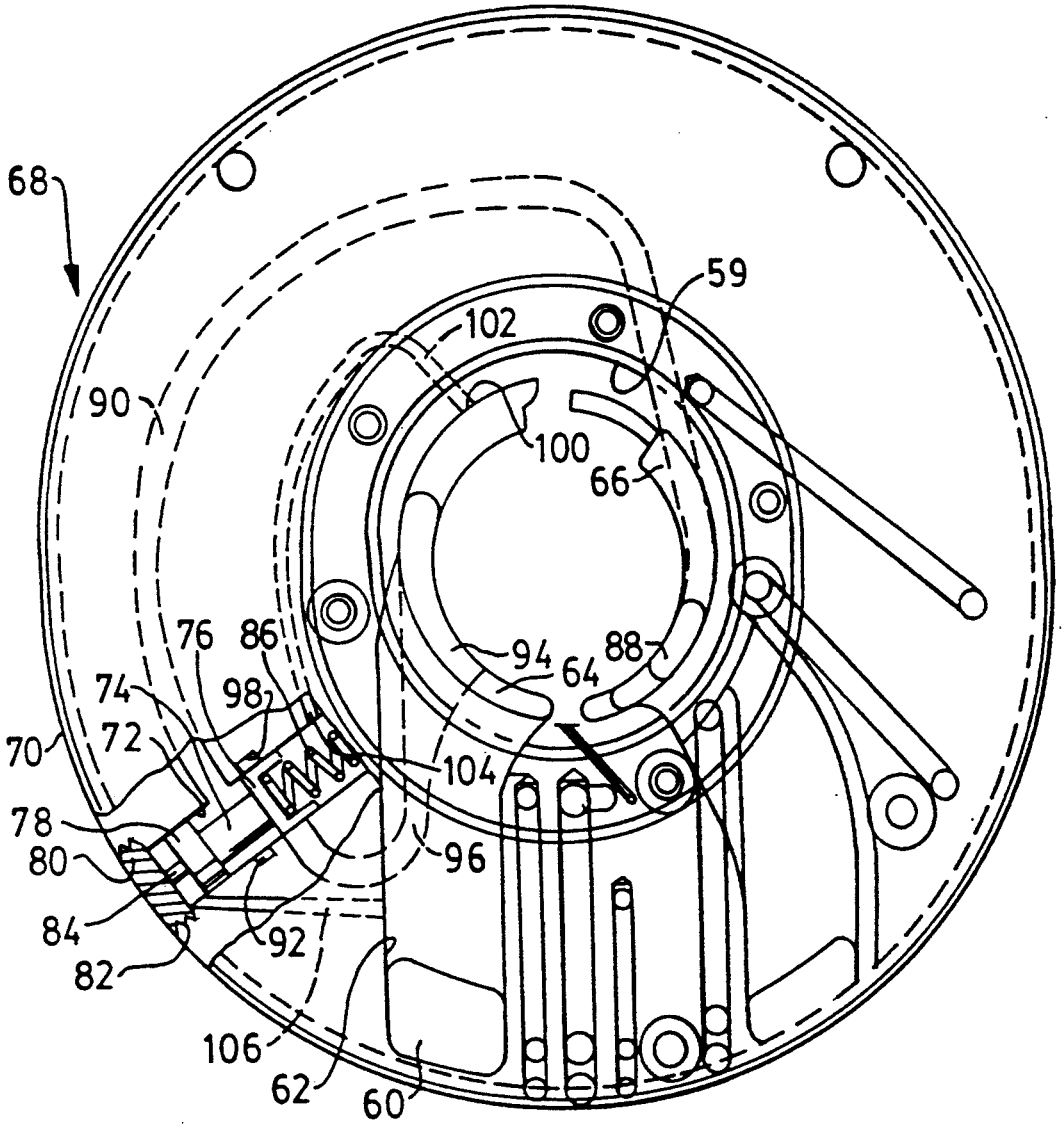
FIG. 5 is a cross section through an hydraulic pump showing a control system valve according to the present invention.

Any of the positive displacement pumps of the types shown in FIGS. 1–4 can be adapted to the control system of FIG. 5. Hydraulic fluid from the reservoir at pressure P1 enters the pump chamber 59 through opening 60, passage 62 and inlet port 64, across which the pumping elements rotate as a rotor or gears turn in chamber 59. As the pump is driven, fluid pumped from inlet port to the diametrically opposite side of the chamber 59 leaves the pumping elements through outlet port 66 to the hydraulic system supplied by the pump 68.

The pump casing 70 is formed with a radially directed bore 72 that contains a valve spool 74 having a first control land 76 and a second land 78, the lands being mutually spaced along the length of the bore. A plug 80 engages screw threads 82 formed in the casing 70 so that the cap seals the bore and provides a surface for contact by stem 84 formed on the end of spool 74. A compression spring 86 urges spool 74 to a position of contact with cap 80.

Outlet port 66 communicates with a flow bypass outlet port 88 connected by flow passage 90 to an annular groove 92 communicating with bore 72.

Inlet port 64 communicates with a flow bypass inlet port 94 connected by flow passage 96 to a port 98 that communicating with bore 72.

Port 100, located at the radially outer end of chamber 59 and inlet port 64, and angularly distant from bypass inlet port 94 at a position where flow in the region is relatively stable, admits fluid to a passage 102, which communicates with bore 72 through port 104 on the opposite side of control land 76 from the location of port 92.

Passage 106 connects inlet passage 62 to the space between cap 80 and control land 78, thereby maintaining low pressure behind control land 78.

The cross sectional area of land 76 and the spring constant of spring 86 are such that, when the difference in pressure at port 100 and pressure in the reservoir inlet passage 62 is relatively low, valve spool 74 is located in the position shown in FIG. 5, whereby a connection between flow passage 96 and the bypass outlet flow passage 90 is closed. In this condition, pump 68 operates normally without compensating for cavitation.

The tangential velocity of fluid in the pump chamber 59 is substantially equal to the tangential velocity at the radially outer end of the gears or vanes carried by the pump rotor. Therefore, as speed of the pumps increases, the velocity pressure of the fluid in the vicinity of port 100 increases and the static pressure $P_2$ at port 100 declines substantially in comparison to the static pressure at port 100 when pump rotor speed are lower. During the high speed condition, the difference in fluid pressure at bypass output port 88 and in passage 90 in comparison to fluid pressure at inlet port 94 and in passage 96 is substantially greater than at lower speed conditions. The effect of this increase of differential pressure causes the fluid to flow from outlet port 88 to inlet port 94 shown in FIG. 5. Because the pressure force developed on land 78 due to pressure Pl, the pressure in the reservoir and in inlet passage 62, increases relative to the pressure force developed on land 76 due to pressure P2. The effect of the change of force magnitudes on spool 74 opens a connection between flow passages 90 and 96, thereby increase the pressure at inlet passage 64 throughout its full angular extent including the region near port 100. When pressure increases at the inlet port, cavitation of the hydraulic fluid is prevented.

The components of the valve can be sized such that the connection between passages 90 and 96 opens when pressure P2 is equal to or less than 10 psi. Alternatively, the components of the valve can be sized such that the connection between passages 90 and 96 opens when the pressure at port 100 is substantially equal to or less than the vapor pressure of the hydraulic fluid.

I claim:

1. A system for controlling operation of an hydraulic pump, comprising:

a source of hydraulic fluid;

an inlet connected to the fluid source;
an outlet;
pumping elements for pumping fluid from the inlet to the outlet;
value means for opening a connection between the outlet and inlet when a pressure difference between the inlet and fluid source reaches a predetermined magnitude and for closing said connection when said pressure difference is below said magnitude, said valve means comprising:
a spool having a control land, movable in a bore;
a first port connecting the inlet and bore, located on a first side of the land;
a second port connecting the fluid source and bore, located on a second side of the land opposite the first side; a spring biasing the spool toward the second port and away from the first port;
a third port connecting the bore and outlet;
a fourth port connecting the inlet and bore, a connection between the third and fourth ports being opened and closed by the land in accordance with the magnitude of said pressure differential, whereby the outlet is connected to the inlet when said pressure differential is equal to or greater than said predetermined pressure differential and disconnected when said pressure differential is less than said predetermined pressure differential.

2. A system for controlling operation of an hydraulic pump, comprising:
a source of hydraulic fluid;
an inlet connected to the fluid source;
an outlet;
pumping elements for pumping fluid from the inlet to the outlet;
valve means for opening a connection between the outlet and inlet when pressure in the inlet is equal to or less than the vapor pressure of the hydraulic fluid and closing said connection when said pressure in the inlet is greater than said vapor pressure, said valve means comprising:
a spool having a control land, movable in a bore;
a first port connecting the inlet and bore, located on a first side of the land;
a second port connecting the fluid source and bore, located on a second side of the land opposite the first side;
a spring biasing the spool toward the second port and away from the first port;
a third port connecting the bore and outlet;
a fourth port connecting the inlet and bore, a connection between the third and fourth ports being opened and closed by the land, whereby the outlet is connected to the inlet when pressure at said first port is equal to or less than the vapor pressure of the hydraulic fluid and disconnected when pressure at said first port is greater than the vapor pressure of the hydraulic fluid.

3. A system for controlling operation of a hydraulic pump, comprising:
a casing defining a chamber therein;
a source of hydraulic fluid;
an inlet communicating with said chamber, connected to the fluid source, extending along an arcuate path;
an outlet communicating with said chamber, spaced from the inlet, extending along an arcuate path;
a rotor located in said chamber, mounted for rotation, carrying mutually spaced pumping elements thereon, space between the pumping elements, rotor and chamber defining pumping chambers that open to the inlet and outlet and carry therein fluid from the inlet to the outlet;
valve means for opening a connection between the outlet and inlet when a pressure difference between the inlet and fluid source reaches a predetermined magnitude and for closing said connection when said pressure difference is below said magnitude, said valve means comprising:
a spool having a control land, movable in a bore;
a first port connecting the inlet and bore, located on a first side of the land;
a second port connecting the fluid source and bore, located on a second side of the land opposite the first side; a spring biasing the spool toward the second port and away from the first port;
a third port connecting the bore and outlet;
a fourth port connecting the inlet and bore, a connection between the third and fourth ports being opened and closed by the land in accordance with the magnitude of said pressure differential, whereby the outlet is connected to the inlet when said pressure differential is equal to or greater than said predetermined pressure differential and disconnected when said pressure differential is less than said predetermined pressure differential.

4. A system for controlling operation of an hydraulic pump, comprising:
a casing defining a chamber therein;
a source of hydraulic fluid;
an inlet communicating with said chamber, connected to the fluid source, extending along an arcuate path;
an outlet communicating with said chamber, spaced from the inlet, extending along an arcuate path;
a rotor located in said chamber, mounted for rotation, carrying mutually spaced pumping elements thereon, space between the pumping elements, rotor and chamber defining pumping chambers that open to the inlet and outlet and carry therein fluid from the inlet to the outlet;
valve means for opening a connection between the outlet and inlet when a pressure difference between the inlet and fluid source reaches a predetermined magnitude and for closing said connection when said pressure difference is below said magnitude, said valve means comprising:
a spool having a control land, movable in a bore;
a first port connecting the inlet and bore, located on a first side of the land;
a second port connecting the fluid source and bore, located on a second side of the land opposite the first side;
a spring biasing the spool toward the second port and away from the first port;
a third port connecting the bore and outlet;
a fourth port connecting the inlet and bore, a connection between the third and fourth ports being opened and closed by the land, whereby the outlet is connected to the inlet when pressure at said first port is equal to or less than the vapor pressure of the hydraulic fluid and disconnected when pressure at said first port is greater than the vapor pressure of the hydraulic fluid.

* * * * *